US009957976B2

(12) United States Patent
Allford

(10) Patent No.: US 9,957,976 B2
(45) Date of Patent: May 1, 2018

(54) TIP TREATMENT BARS IN A GAS TURBINE ENGINE

(71) Applicant: ROLLS-ROYCE PLC, London (GB)

(72) Inventor: Peter Allford, Bristol (GB)

(73) Assignee: ROLLS-ROYCE plc, London (GB)

( * ) Notice: Subject to any disclaimer, the term of this patent is extended or adjusted under 35 U.S.C. 154(b) by 250 days.

(21) Appl. No.: 14/494,103

(22) Filed: Sep. 23, 2014

(65) Prior Publication Data

US 2015/0104298 A1 Apr. 16, 2015

(30) Foreign Application Priority Data

Oct. 11, 2013 (GB) ..... 1318036.9

(51) Int. Cl.

| | |
|---|---|
| ***F04D 29/54*** | (2006.01) |
| ***F04D 29/16*** | (2006.01) |
| ***F04D 29/52*** | (2006.01) |
| ***F04D 29/68*** | (2006.01) |

(52) U.S. Cl.

CPC ..... *F04D 29/547* (2013.01); *F04D 29/164* (2013.01); *F04D 29/526* (2013.01); *F04D 29/685* (2013.01)

(58) Field of Classification Search

CPC .... F04D 29/547; F04D 29/526; F04D 29/164; F04D 29/685

See application file for complete search history.

(56) References Cited

U.S. PATENT DOCUMENTS

| | | | | |
|---|---|---|---|---|
| 3,339,833 | A * | 9/1967 | Bill | F01D 9/042 415/210.1 |
| 6,497,551 | B1 | 12/2002 | Hand et al. | |
| 2002/0000086 | A1 | 1/2002 | Allford et al. | |
| 2002/0122719 | A1* | 9/2002 | Clark | F01D 25/04 415/119 |
| 2002/0122721 | A1* | 9/2002 | Collins | F01D 5/145 415/173.1 |

FOREIGN PATENT DOCUMENTS

| | | |
|---|---|---|
| GB | 2 363 167 A | 12/2001 |
| WO | 94/20759 A1 | 9/1994 |

OTHER PUBLICATIONS

Feb. 4, 2015 European Search Report issued in European Application No. 14185897.

Apr. 17, 2014 Search Report issued in GB Application No. 1318036.9.

* cited by examiner

*Primary Examiner* — Logan Kraft
*Assistant Examiner* — Danielle M Christensen
(74) *Attorney, Agent, or Firm* — Oliff PLC

(57) ABSTRACT

There is presented a casing arrangement for a gas turbine engine. The casing arrangement includes a plurality of tip treatment bars extending between a pair of spaced-apart annular supports, with each tip treatment bar being elongate and supported at each end by a respective support such that each end of the bar is received within an opening formed in the respective support. At least the ends of each tip treatment bar are tapered in transverse cross-section so as to have a wedge-shaped profile, and the openings in the supports have a complementary tapered shape for receipt and retention of the bar ends therein.

12 Claims, 4 Drawing Sheets

TIP TREATMENT BARS IN A GAS TURBINE ENGINE

CROSS-REFERENCE TO RELATED APPLICATIONS

This application is based upon and claims the benefit of priority from British Patent Application Number 1318036.9 filed 11 Oct. 2013, the entire contents of which are incorporated by reference.

BACKGROUND OF THE DISCLOSURE

1. Field of the Disclosure

The present disclosure relates to tip treatment bars for a gas turbine engine. Aspects of the disclosure relates to a casing arrangement for a gas turbine engine, having tip treatment bars.

2. Description of the Related Art

W094/20759 discloses an anti-stall tip treatment means in a gas turbine engine, in which an annular cavity is provided adjacent the blade tips of a compressor rotor. The cavity communicates with the gas flow path through the compressor past a series of bars extending across the mouth of the cavity.

Such tip treatments are applicable to both fans and compressors of gas turbine engines, and their purpose is to improve the blade stall characteristics or surge characteristics of the compressor.

Movement of the blade tips past the bars creates vibrations in the bars which, over time, can result in high cycle fatigue failure of the bars. This failure is caused by vibration resonance between the tip treatment bars and the natural engine order modes. It has therefore been proposed previously to isolate the tip treatment bars from the support structure which is used to support the bars in position. An example of such isolation involves supporting the opposite ends of each tip treatment bar in respective apertures provided in axially spaced-apart annular supports, with damping elements being provided between the surfaces of the bar ends and the internal walls of the support apertures. In prior art arrangements of this type, it is usual for the tip treatment bars to incorporate shoulders towards each end to ensure proper axial location of the bars in the apertures provided in the annular supports. It has been found that this type of arrangement can be relatively complicated and expensive to produce.

OBJECTS AND SUMMARY

It is a preferred object of the present invention to provide an improved engine casing arrangement for a gas turbine engine, having tip treatment bars.

According to the present invention there is provided a casing arrangement for a gas turbine engine, the casing arrangement including a plurality of tip treatment bars extending between a pair of spaced-apart annular supports, each tip treatment bar being elongate and supported at each end by a respective said support such that each end of the bar is received within an opening formed in the respective support, wherein at least the ends of each tip treatment bar are tapered in transverse cross-section so as to have a wedge-shaped profile, and said openings in the supports have a complementary tapered shape for receipt and retention of the bar ends therein.

In preferred arrangements, said openings and said ends of the tip treatment bars are both tapered so as to be wider at their radially outer regions than their radially inner regions.

Each tip treatment bar is preferably tapered in transverse cross-section along its entire length. Furthermore, each tip treatment bar may be uniform in transverse cross-section along its entire length.

In a preferred embodiment, the openings in the end supports are each provided in the form of a slot having a closed radially outermost end, and an open radially innermost end. The slots may thus be open generally towards the rotational axis of the engine.

At least one of said supports (and optionally both) may be configured to define a stop surface adjacent each of its openings for locating engagement by the end surfaces of the tip treatment bars.

In a preferred embodiment said stop surfaces are all defined by a rib extending along the support. The rib may extend along the radially innermost region of the support, and may optionally serve to contribute stiffness to the structure of the support.

In preferred arrangements, said rib is formed as an integral feature of the support.

Each tip treatment bar may be isolated, at at least one end (and preferably at both), from the respective support by damping means.

Preferably, said damping means includes a damping element located between each tip treatment bar and adjacent surfaces of the respective opening in which an end of the bar is received Conveniently, the damping elements are formed from an elastomer.

In order to facilitate convenient installation in a gas turbine engine, the annular supports may be configured such that each is made up from a plurality of arcuate support elements defining respective sectors of the annular supports, the support elements being provided in pairs, with the support elements of each said pair being spaced apart by a plurality of said tip treatment bars extending therebetween.

BRIEF DESCRIPTION OF THE DRAWINGS

So that the disclosure may be more readily understood, and so that further features thereof may be appreciated, embodiments will now be described by way of example with reference to the accompanying drawings in which.

DETAILED DESCRIPTION OF EMBODIMENTS

Figure 1:
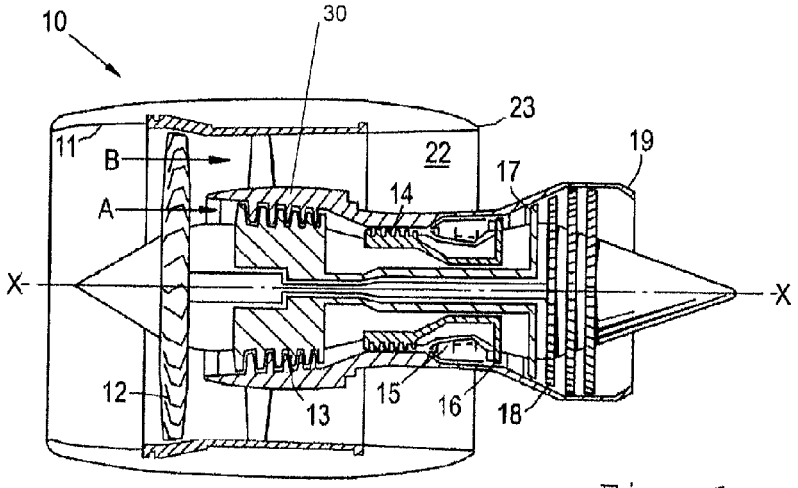
FIG. 1 shows schematically a longitudinal axial section through a gas turbine engine.

Turning now to consider the drawings in more detail, FIG. 1 shows a ducted fan gas turbine engine which may incorporate the invention. The engine is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Figure 2:
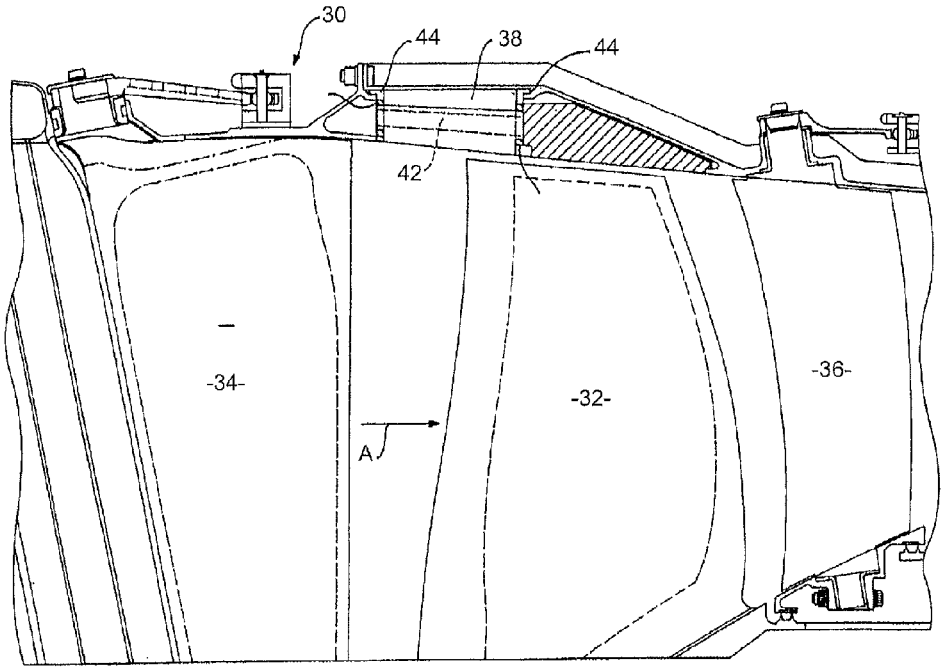
FIG. 2 is a partial axial sectional view of a compressor stage in a gas turbine engine.

FIG. 2 shows a region of the casing 30 surrounding the intermediate pressure compressor 13 in more detail. However, it should be appreciated that the invention described below, whilst being shown installed within the intermediate pressure compressor casing 30, could be installed in any casing, such as any compressor casing including, for example, the respective casings associated with the propulsive fan 12 or the high pressure compressor 14.

A rotor, represented in FIG. 2 by a single rotor blade 32, is mounted for rotation within the casing 30, about the rotational axis X-X. Respective guide vanes 34, 36 are provided upstream and downstream of the rotor 32. The casing 30 includes a circumferentially extending chamber 38, which communicates with the main gas flow A through the compressor via an array of slots 40 (shown most clearly in FIG. 4) defined between adjacent tip treatment bars 42 disposed around the casing 30. The function of the chamber 38 and the tip treatment bars 42 in delaying the onset of stall across the compressor blades 32 is known, and is disclosed in WO94/20759.

Figure 3:
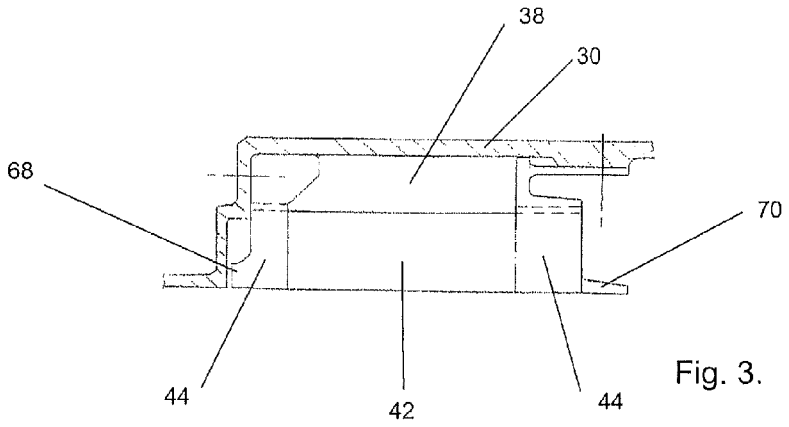
FIG. 3 is an enlarged axial sectional view of part of the casing of the engine, showing an arrangement in accordance with the present invention.
Figure 4:
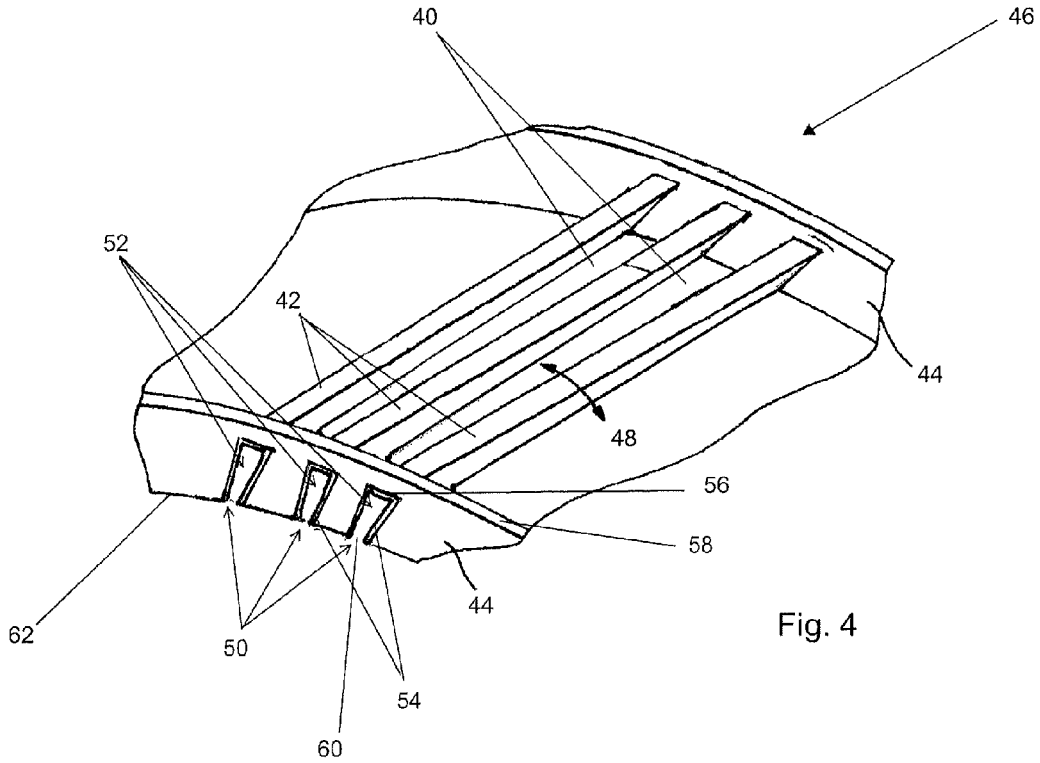
FIG. 4 is a perspective view showing a number of tip treatment bars extending between a pair of supports, forming part of the arrangement of the present invention.

The tip treatment bars 42 are each elongate in form and are supported at their opposed ends by a pair of axially spaced-part annular supports 44 to provide a tip treatment ring 46 which is fitted within the chamber 38 of the casing 30, so to extend around the compressor rotor 32. FIG. 3 shows an enlarged axial sectional view through the tip treatment ring 46 and the chamber 38, and FIG. 4 shows a small sector of the tip treatment ring 46, with only three tip treatment bars 42 illustrated, for clarity. It is to be appreciated that a larger number of tip treatment bars 42 will be provided in an actual installation, the bars being equi-spaced around the entire tip treatment ring 46.

Figure 5:
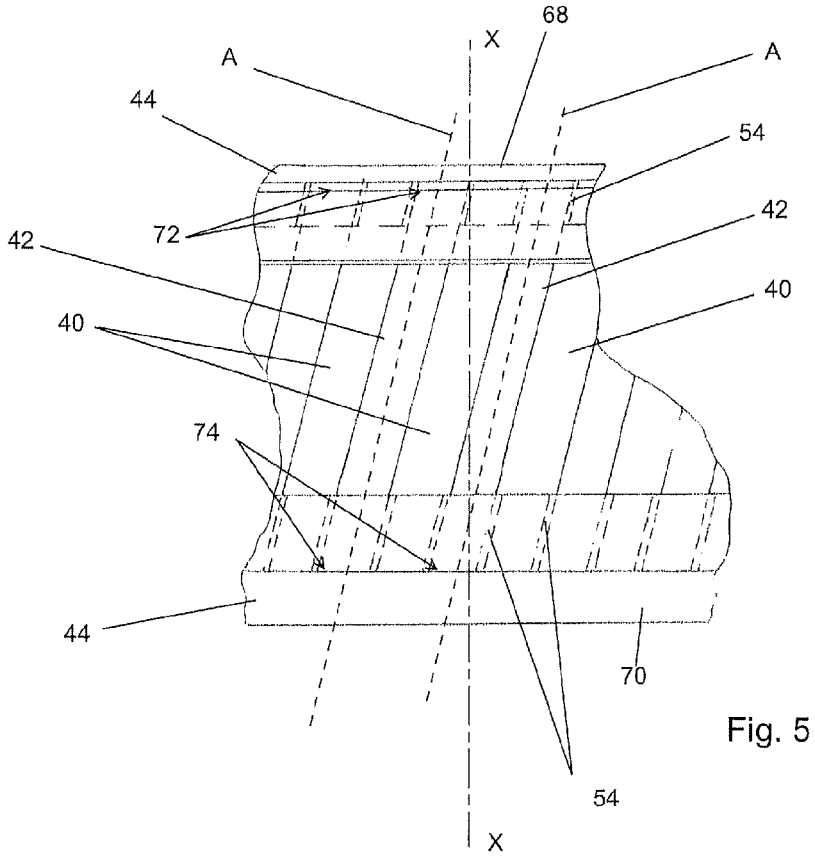
FIG. 5 is a schematic radial view showing the tip treatment bars and supports of the arrangement shown in FIG. 4.

As shown most clearly in the radial view of FIG. 5, the tip treatment bars 42 are arranged so as to be parallel to one another. However, in the preferred arrangement illustrated, the bars 42 are oriented such that their primary axes A make an acute angle to the principal rotational axis X-X of the engine.

Vibration is induced in the tip treatment bars 42 during operation of the engine, at a frequency which is determined by the movement of the rotor blades 32 past the bars 42. The vibrating bars 42 deflect in a generally circumferential direction as indicated diagrammatically by arrow 48 in FIG. 4. The degree of vibration induced in this manner can lead to fatigue failure of the bars 42 if it is not carefully managed.

The bars 42 are formed separately from the spaced-apart end supports 44. Each support 44 has an array of spaced-apart openings 50 provided through it, with each opening 50 being configured for receipt of the end region 52 of a respective bar 42. Damping means are provided in the form of discrete damping elements 54, each of which is provided around the periphery of a respective opening 50 so as to locate between the end region of the respective bar 42 and the adjacent surfaces of the opening, to thereby isolate the end region 52 of the bar from the support 44. In order to accommodate the damping elements 54, the openings 50 formed in the supports 44 have a shape which is complementary to, but somewhat larger than, the transverse cross-sectional shape of the end regions 54 of the bars 42.

Each damping element 54 may be formed as a separate component before assembly with its respective tip treatment bar 42 and the end supports 44. Alternatively, the damping elements 54 may be formed by moulding the damping material (preferably a silicone elastomer) in situ between the tip treatment bars 42 and the supports 44, in a potting process.

In operation, the vibration induced in the bars 42 is effectively damped by the damping material of the damping elements 54, thereby reducing the amplitude of vibration and inhibiting the initiation and propagation of high cycle fatigue cracking.

As illustrated in FIG. 4 (which actually shows the supports 44 with parts omitted for clarity, but which are described in detail hereinafter), the end regions 54 of the tip treatment bars 42 are tapered in transverse cross-section such that each bar 42 has a wedge-shaped profile which is wider at its radially outer region than its radially inner region. The openings 50 formed in the supports 44 each have a complementary tapered shape for receipt and retention of the bar ends 54 therein.

In more detail, it is to be noted from FIG. 4 that the openings 50 are each provided in the form of a slot having a closed radially outermost end, which is spaced from the radially outermost edge 58 of the support 44, and an open radially innermost end 60 which is formed as a discontinuity in the radially innermost edge 62 of the support 44. The slots 50 are thus open towards the rotational axis X-X of the engine (not shown in FIG. 4).

Figure 6:
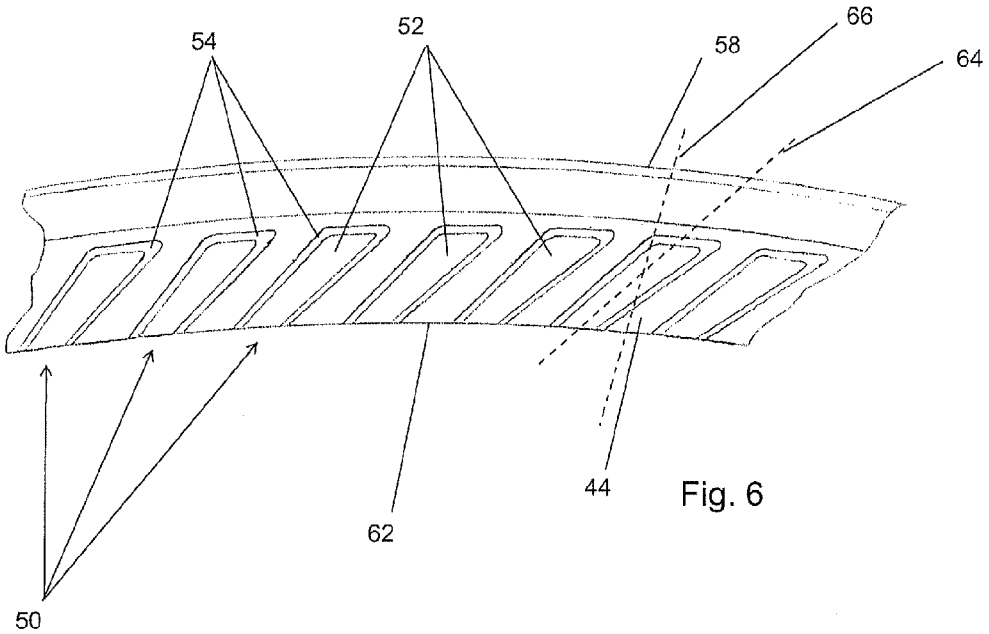
FIG. 6 is partial transverse sectional view taken through one of the supports of the present invention.

As illustrated most clearly in FIG. 6, the slots defining the openings 50 are each oriented such that their central axes 64 (about which the taper of their profile may be symmetrical) make an acute angle to the radial direction as denoted by line 66. This orientation of the openings 50 means that the tip treatment bars 52 supported therein are orientated with a compound angular lean around the ring 46.

In the favoured embodiment illustrated, the tip treatment bars 42 each have a uniform transverse cross-sectional profile along their entire length. This means that the bars 42 can be manufactured at considerably less expense (for example by extrusion) than prior art configurations which typically have a more complicated shape with changes in cross-section along the length of the bars (and which thus cannot be extruded).

As indicated above, for the sake of clarity FIG. 4 omits features of the two supports 44. These features will now be described in more detail with particular reference to FIGS. 7 and 8, although they are also shown in FIGS. 3 and 5. In this regard, it is to be noted that each support is provided with a respective rib 68, 70, which extends along the radially innermost region of the support 44.

Figure 7:
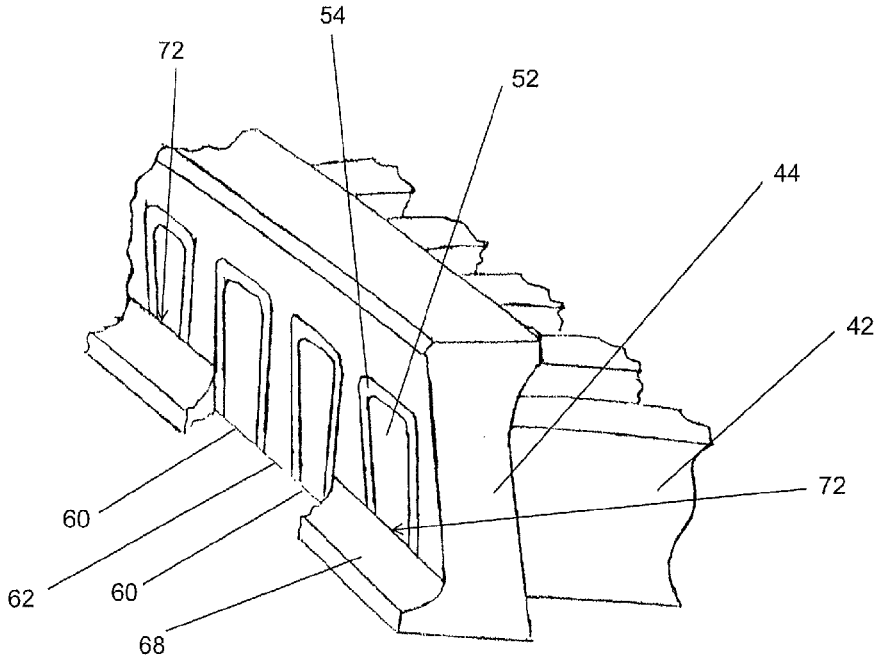
FIG. 7 is a perspective view showing one of the supports with part cut away.

FIG. 7 illustrates the upstream support 44, which is the one located to the left hand side of FIG. 3. As can be seen, the rib 68 of this support is provided on the upstream side of the support 44 and runs along the length of the radially innermost edge 62 of the support, so as to cover the radially innermost region of each opening 50. FIG. 7 shows a region of the rib cut-away so as show the extent to which the openings 50 are each covered in their radially innermost regions. The rib 68 is preferably formed as an integral feature of the support 44 and may contribute to the stiffness of the support 44.

As will thus be noted, the rib 68 effectively defines a series of stop surfaces 72 at positions where it extends across respective openings 50. The stop surfaces are shown most clearly in FIG. 5. These stop surfaces 72 are each configured for locating engagement by the upstream end surface of a respective tip treatment bar 42, thereby ensuring accurate axial alignment of the tip treatment bars 42 relative to the support 44.

Figure 8:
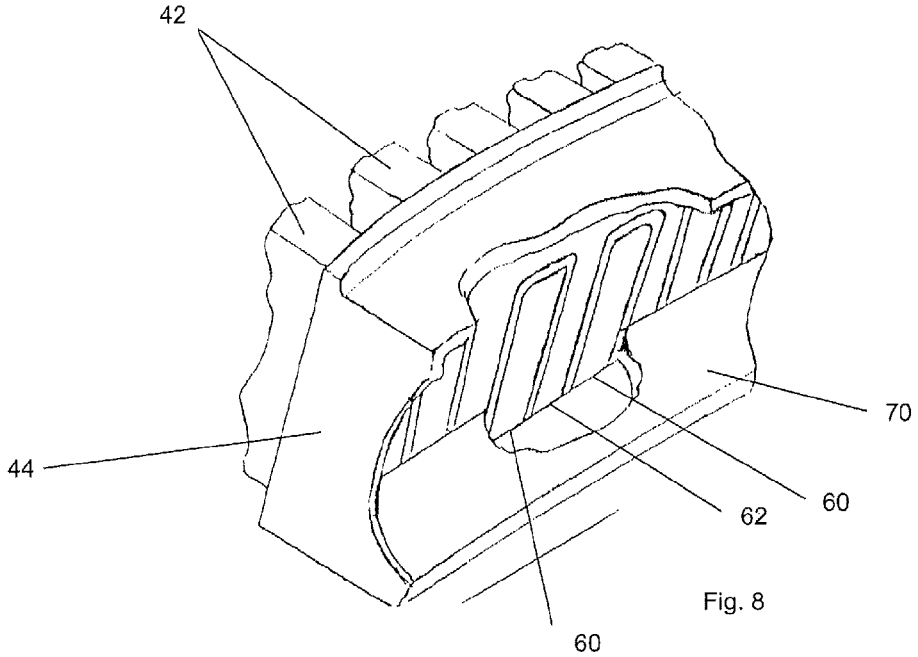
FIG. 8 is a perspective view showing the other support with part cut away.

FIG. 8 illustrates the downstream support 44, which is the one located to the right hand side of FIG. 3. Although it will be noted that in the particular embodiment of the invention illustrated in the drawings the two supports 44 have a slightly different shape to one another in transverse cross-section, this is largely a function of the particular engine design in which they are intended to be installed. It should therefore be appreciated that in other embodiments, the two supports 44 could have a substantially identical configuration to one another. Nevertheless, having regard to FIG. 8, it will be noted that the rib 70 of the downstream support 44 is provided on the downstream side of the support and runs along the length of the radially innermost edge of the support. The rib 70 thus also covers the radially innermost region of each opening. FIG. 8 again shows a region of the rib cut-away so as to show the extent to which the openings 50 are each covered in their radially innermost regions. In a similar manner to the upstream support shown in FIG. 7, the rib 70 is preferably formed as an integral feature of the downstream support 44 and may contribute to the stiffness of the support.

As will thus be appreciated, in a similar manner to the rib 68 of the upstream support 44, the rib 70 of the downstream support effectively defines a series of stop surfaces 74 at positions where it extends across respective openings 50. The stop surfaces 74 are shown most clearly in FIG. 5. These stop surfaces 74 are each configured for locating engagement by the downstream end surface of a respective tip treatment bar 42, thereby ensuring accurate axial alignment of the tip treatment bars 42 relative to the support 44.

The axial locating function of the ribs 68, 70 described above is considered particularly important in arrangements in which the tip treatment bars 44 have a uniform transverse cross-section along their length. In prior art arrangements in which the tip treatment bars do not have a uniform cross section along their length, axial locating features are provided on the bars themselves; for example in the form of shoulders provided towards the ends of the bars to engage and located against respective surfaces on the supports. In the arrangement of the present invention, the provision of the locating ribs 68, 70 on the supports 44 allows the tip treatment bars 42 to be produced with a uniform transverse cross-section.

It is to be noted that for ease of assembly within an engine 10, the annular supports 44 may each be made up from a plurality of arcuate support elements which, when assembled in end-to-end relation to one another will define the complete annulus of each support 44. It is envisaged that the support elements of each sector will be provided in pairs, pre-assembled so as to be spaced apart by a plurality of tip treatment bars extending therebetween. For example, in an engine installation having a total of 154 tip treatment bars provided around the casing 30, the tip treatment ring 46 could be assembled from eleven pre-assembled pairs of support segments, each pair having a total of fourteen tip treatment bars 42 extending therebetween.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

We claim:

1. A casing arrangement for a gas turbine engine, the casing arrangement including a plurality of tip treatment bars extending between a pair of spaced-apart annular supports, each tip treatment bar being elongate with axial extents defined by opposing end surfaces, and supported at each end by a respective said support such that each end of the bar is received within an opening formed in the respective support, wherein:

each tip treatment bar has a tapered, uniform transverse cross-section along its entire length so as to have a wedge-shaped profile, and said openings in the supports have a complementary tapered shape for receipt and retention of the bar ends therein; and at least one of said supports includes a stop surface adjacent each of its openings that is configured to prevent the end surfaces of the tip treatment bars from extending axially past the openings of the supports thereby ensuring accurate axial alignment of the tip treatment bars relative to said supports.

2. A casing arrangement according to claim 1, wherein said openings and said ends of the tip treatment bars are both tapered so as to be wider at their radially outer regions than their radially inner regions.

3. A casing arrangement according to claim 1, wherein the openings in the end supports are each provided in the form of a slot having a closed radially outermost end, and an open radially innermost end, the slots thus being open generally towards the rotational axis of the engine.

4. A casing arrangement according to claim 1, wherein said stop surfaces are all defined by a rib extending along the support.

5. A casing arrangement according to claim 4, wherein said rib extends along the radially innermost region of the support.

6. A casing arrangement according to claim 4, wherein said rib serves to contribute stiffness to the structure of the support.

7. A casing arrangement according to claim 4, wherein said rib is formed as an integral feature of the support.

8. A casing arrangement according to claim 1, wherein each tip treatment bar is isolated, at one or both ends, from the respective support by damping means.

9. A casing arrangement according to claim 8, wherein each tip treatment bar is isolated, at both ends, from the respective supports.

10. A casing arrangement according to claim 8, wherein said damping means includes a damping element located between each tip treatment bar and adjacent surfaces of the respective opening in which an end of the bar is received.

11. A casing arrangement according to claim 10, wherein the damping elements are formed from an elastomer.

12. A casing arrangement according to claim 1, wherein the annular supports are each made up from a plurality of arcuate support elements defining respective sectors of the annular supports, the support elements being provided in pairs, with the support elements of each said pair being spaced apart by a plurality of said tip treatment bars extending therebetween.

* * * * *